United States Patent [19]

Coetzee

[11] 4,148,310

[45] Apr. 10, 1979

[54] DEVICE FOR PROTECTION AGAINST SEXUAL ASSAULT

[76] Inventor: Dirk J. Coetzee, 9 Averill Str., Southdale, Johannesburg, South Africa

[21] Appl. No.: 831,435

[22] Filed: Sep. 8, 1977

[30] Foreign Application Priority Data

Sep. 13, 1976 [ZA] South Africa ..... 76/5464

[51] Int. Cl.[2] ..... A61B 19/00

[52] U.S. Cl. ..... 128/138 R; 124/20 B

[58] Field of Search ..... 128/132 R, 138, 329, 128/330; 124/1, 20 R, 20 B

[56] References Cited

U.S. PATENT DOCUMENTS

| | | | |
|---|---|---|---|
| 4,016,875 | 4/1977 | Levesque | 128/132 R |
| 4,030,090 | 6/1977 | Vogel | 128/130 |

*Primary Examiner*—Lawrence W. Trapp

*Attorney, Agent, or Firm*—Young & Thompson

[57] ABSTRACT

A device for personal protection against sexual assault. The device consists of a tube which is closed at one end open at the other and adapted to be located in an orifice in the body of a person, a weapon, such as a pointed shaft, in the tube, means in the tube biasing the weapon towards the outside of the tube through the open end and a trigger at the open end of the tube adapted to hold the shaft in the tube against the bias of the biasing means and to release the shaft to the biasing means on application of pressure to the trigger in the axial direction of the tube.

7 Claims, 1 Drawing Figure

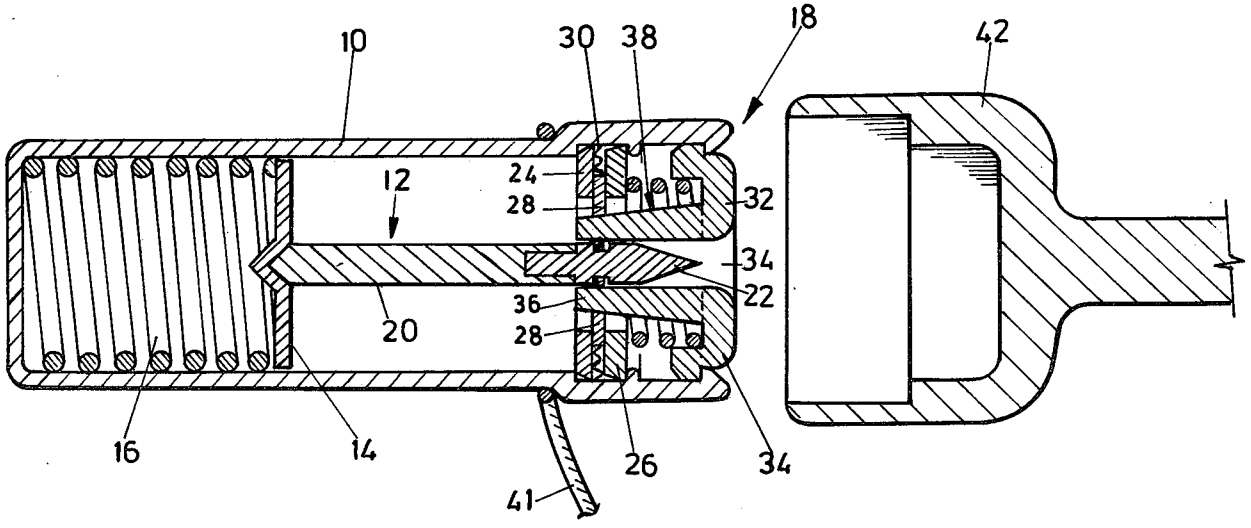
42
18
38
30
10
12
24
28
32
34
22
20
36
28
26
34
14
16
41

DEVICE FOR PROTECTION AGAINST SEXUAL ASSAULT

BACKGROUND TO THE INVENTION

This invention relates to a device for personal protection against sexual assault.

SUMMARY OF THE INVENTION

A device according to the invention for personal protection against sexual assault comprises a tube which is open at one end and closed at the other and adapted for insertion into an orifice in the body of a person, a weapon in the tube which is movable between a first position in which it is fully retracted into the tube and a second position in which it at least projects from the open end of the tube, means in the tube biasing the weapon towards its second position and a pressure-activated trigger at the open end of the tube adapted releasibly to hold the weapon in its first position against the bias of the biasing means.

Further according to the invention the weapon is a pointed shaft. Preferably the pointed end of the shaft is distinct from the remainder of the shaft and is loosely connected thereto by a spigot on one member and a socket on the other.

In one form of the invention the shaft includes a catch and the trigger includes a detent which is movable in a radial direction in the tube and is adapted to engage the catch in the first position of the shaft, and means adapted on applied pressure to move the detent from the catch and so release the shaft to the bias of the biasing means.

BRIEF DESCRIPTION OF THE DRAWING

The drawing shows, by way of example, one embodiment of the device of the invention in cross-sectional side elevation.

DETAILED DESCRIPTION OF THE DRAWING

The drawing shows the device of the invention to consist of a tube 10 which is closed at one end and open at the other, a weapon 12, a piston 14, a spring 16 and a trigger mechanism indicated generally at 18.

The tube 10 is made from a smooth resilient material such as plastic.

The weapon 12 consists of a shaft 20 one end of which is pointed and located in a dimple in the centre of the piston 14. The other end of the shaft carries a socket in which a spigot on a pointed removable head 22 is loosely located. The head 22 carries a peripheral groove.

The trigger mechanism 18 consists of two spaced holed discs 24 and 26 which are located in a groove near the open end of the tube 10, two detents 28 which are located between the discs and are movable against the bias of leaf springs 30 from the position shown in the drawing, in which they are located in the groove in the head 22, radially outwardly and an actuator 32.

The actuator 32 serves as a closure member for the tube 10 and includes a peripheral flange which bears against a stop at the mouth of the tube, an opening 34 and two inwardly directed arms 36. The radially outer surfaces 38 of the arms 36 slope upwardly from the free ends towards the mouth of the tube.

The detents 28 each include a slot in which the free end of an arm 36 of the actuator is located with the surface 38 bearing on the base or upper edge of the slot.

A spring 40 is located in the tube between the disc 26 and the actuator to bias the actuator to the position shown in the drawing.

A cord 41 may be attached to the tube 10 to facilitate removal of the device from its position of use.

To prevent the ingress of moisture into the device the open end of the tube may be covered by a membrane of plastic or rubber-like material, not shown.

In use, the device is inserted into an orifice of person, conveniently by means of an applicator 42 which is frictionally engageable with the tube at or near its open end and left in position. Pressure on the actuator causes it to move into the tube in an axial direction and in so doing the ramped surfaces 38 of the arms 36 lift the detents 28 against the bias of the springs 30 from the groove in the head 22 to release the plunger to the bias of the spring 14.

I claim:

1. A device for personal protection against sexual assault comprising a tube which is open at one end and closed at the other and adapted for insertion into an orifice in the body of a person, a weapon in the tube which is movable between a first position in which it is fully retracted into the tube and a second position in which it at least projects from the open end of the tube, means in the tube biasing the weapon towards its second position and a pressure activated trigger at the open end of the tube adapted releasibly to hold the weapon in its first position against the bias of the biasing means.

2. A device as claimed in claim 1 in which the weapon is a pointed shaft.

3. A device as claimed in claim 2 in which the pointed end of the shaft is distinct from the remainder of the shaft and is loosely connected thereto by a spigot on one member and a socket on the other.

4. A device as claimed in claim 1 including a piston in the tube which bears on the weapon and the biasing means is a spring which acts between the piston and fixed structure in the tube.

5. A device as claimed in claim 2 in which the shaft includes a catch and the trigger includes a detent which is movable in a radial direction in the tube an is adapted to engage the catch in the first position of the shaft, and means adapted on applied pressure to move the detent from the catch and so release the shaft to the bias of the biasing means.

6. A device as claimed in claim 5 in which the detent includes an aperture and the detent moving means is a holed closure member for the open end of the tube which is movable in the axial direction of the tube and includes a formation which projects into the aperture in the detent and has a sloping surface which is adapted on application of a predetermined pressure to move the detent radially outwardly out of engagement with the catch in the shaft so that at least the pointed end of the shaft will pass under the influence of the biasing means through the hole in the closure.

7. A device as claimed in claim 6 in which a stop is located at the open end of the tube and the device includes a spring which is adapted to bias the closure member against the stop.

* * * * *